US006538553B2

(12) United States Patent
Yu

(10) Patent No.: US 6,538,553 B2
(45) Date of Patent: Mar. 25, 2003

(54) SWITCHING ELEMENT FOR ELECTRIC SWITCH

(76) Inventor: Tsung-Mou Yu, 4, Sublane 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 6 days.

(21) Appl. No.: 09/903,568

(22) Filed: Jul. 13, 2001

(65) Prior Publication Data

US 2003/0011461 A1 Jan. 16, 2003

(51) Int. Cl.[7] ..... H01H 37/54; H01H 61/01; H01H 5/24

(52) U.S. Cl. ..... 337/365; 337/89; 337/362; 337/368; 200/407

(58) Field of Search ..... 337/365, 367, 337/368, 372, 362, 89, 91, 94; 200/402, 405–407

(56) References Cited

U.S. PATENT DOCUMENTS

| | | | | | |
|---|---|---|---|---|---|
| 2,533,671 | A | * | 12/1950 | Jacobs, Jr. | 200/407 |
| 2,584,460 | A | * | 2/1952 | Jacobs, Jr. | 200/407 |
| 2,624,819 | A | * | 1/1953 | Spina et al. | 200/407 |
| 2,701,475 | A | * | 2/1955 | Readeker | 200/406 |
| 2,777,032 | A | * | 1/1957 | Burch | 200/407 |
| 3,196,233 | A | * | 7/1965 | Burch et al. | 200/406 |
| 3,213,228 | A | * | 10/1965 | Burch et al. | 200/407 |
| 3,872,417 | A | * | 3/1975 | Hufschmid | 200/406 |
| RE28,578 | E | * | 10/1975 | Burch et al. | 200/407 |
| 4,032,734 | A | * | 6/1977 | Burch | 200/288 |
| 4,118,610 | A | * | 10/1978 | Purssell et al. | 200/275 |
| 4,145,587 | A | * | 3/1979 | Purssell | 200/407 |
| 4,224,488 | A | * | 9/1980 | Rossi | 200/251 |
| 4,250,367 | A | * | 2/1981 | Rossi | 200/275 |
| 4,278,855 | A | * | 7/1981 | Rossi | 200/275 |
| 4,325,046 | A | * | 4/1982 | Burch | 337/358 |
| 4,424,506 | A | * | 1/1984 | Burch | 200/406 |
| 4,796,355 | A | * | 1/1989 | Burch et al. | 228/173.6 |
| 5,555,972 | A | * | 9/1996 | Schwab | 200/407 |
| 5,760,672 | A | * | 6/1998 | Wang | 337/66 |
| 5,790,010 | A | * | 8/1998 | Schwab | 200/407 |

FOREIGN PATENT DOCUMENTS

| | | | | | |
|---|---|---|---|---|---|
| JP | 01151122 | A | * | 6/1989 | H01H/23/24 |

* cited by examiner

*Primary Examiner*—Anatoly Vortman
(74) *Attorney, Agent, or Firm*—Rosenberg, Klein & Lee

(57) ABSTRACT

A switching element of a sheet of resilient metal having high and low heat-expansive sides, the switching element having a middle leg carrying an electric contact for making and breaking a circuit with a stationary contact on a substrate below, first and second outer legs each having one end connected to the same end of the middle leg, and an arm of width smaller than ⅓ of the width of said switching arm extended outwards from the connecting area between the middle leg and the outer legs in longitudinal alignment with the middle leg for pulling upwards/pushing downwards by an external force to reverse the middle leg.

2 Claims, 9 Drawing Sheets

SWITCHING ELEMENT FOR ELECTRIC SWITCH

BACKGROUND OF THE INVENTION

The present invention relates to electric switches and, more particularly, to a resilient metal switching element for use in an electric switch.

U.S. Pat. No. 2,777,032 discloses a resilient switching element for use in a snap switch. As illustrated in FIGS. from 1 through 4, the switching element 1 is a unitary element stamped in one piece from resilient thin sheet metal, comprising a pair of spaced supporting legs 11, and a center leg 12 extending therebetween. The supporting legs 11 are connected to the center leg 12 by a pair of substantially semicircular loops. During installation, the supporting legs 11 are horizontally turned inwards toward each other to shorten the distance therebetween from distance X shown in FIG. 1 to distance Y shown in FIG. 2, and then the ends of the supporting legs 11 are fixedly fastened to the substrate 2. In order to let the center leg 12 to be distorted and reversed to switch on/off the circuit, a fulcrum 21 is provided engaging one side, and actuators 22;23 are provided and adapted to engage the other side of the center leg 12. U.S. Pat. Nos. 3,196,233; 2,624,819 disclose similar designs.

FIGS. From 5 through 10 shows a switching element for use in a safety switch built-in with protecting circuit constructed subject to U.S. Pat. No. 5,760,672. The switching element 3 is formed of a sheet of resilient metal having high and low heat-expansive sides. The switching element 3 has a middle leg 31 carrying one electric contact 32 for making and breaking a circuit with a stationary contact, and first and second outer legs each having one end portion connected to the same end of the middle leg 31. During installation, the outer legs are squeezed inwards toward each other to narrow the gap T1 between the free ends of the outer legs, so that the width of the mounting side is reduced from W1 to W2 (see FIGS. 5 and 6). After installation in a support 4, the switching element 3 is curved inwards/outwards, causing the middle leg 31 to move the contact 32 upwards/downwards so as to switch on/off the circuit. The switching element 3 further has a through hole 33 at the center of the connection area between the middle leg 31 and the end portions of the outer legs, which receives a push and pull rod 34 that is driven to curve the switching element 3 inwards/outwards. Further, top stop rod 35 and bottom stop rod 36 are vertically spaced from the switching element 3 at two sides, and adapted to impart a reversing force to the switching element 3. Without the stop rod 35 or 36, the switching element 3 cannot be reversed.

SUMMARY OF THE INVENTION

It is the main object of the present invention to provide a switching element, which simplifies the external arrangement of the electric switch. According to the present invention, the switching element is formed of a sheet of resilient metal having high and low heat-expansive sides. The switching element has a middle leg carrying an electric contact for making and breaking a circuit with a stationary contact on a substrate below, first and second outer legs each having one end connected to the same end of the middle leg, and an arm of width smaller than ⅓ of the width of said switching arm extended outwards from the connecting area between the middle leg and the outer legs in longitudinal alignment with the middle leg for pulling upwards/pushing downwards by an external force to reverse the middle leg.

DETAILED DESCRIPTION OF THE PREFERRED EMBODIMENT

Figure 11:
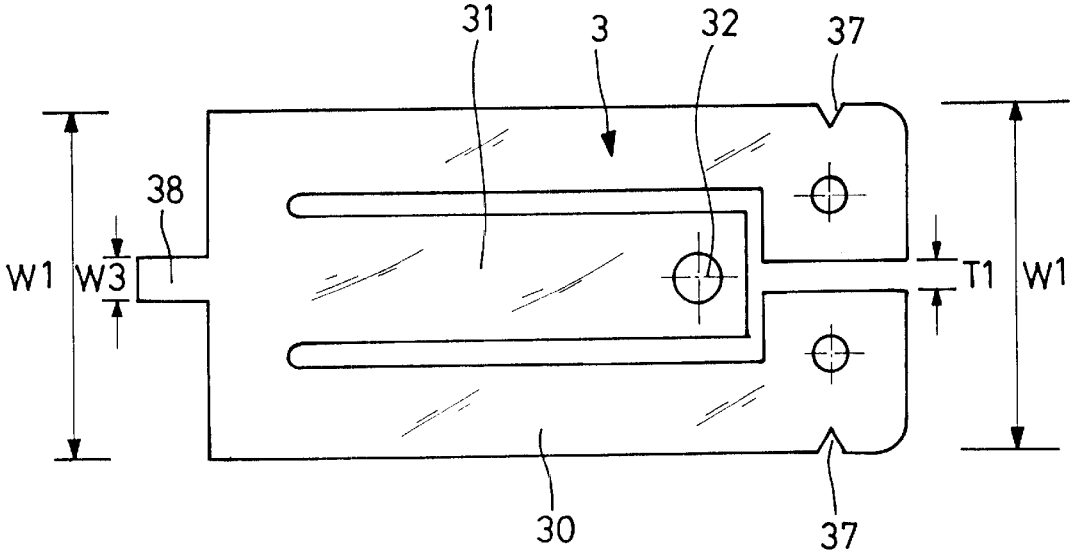
FIG. 11 is a top view of a switching element constructed according to the present invention.
Figure 12:
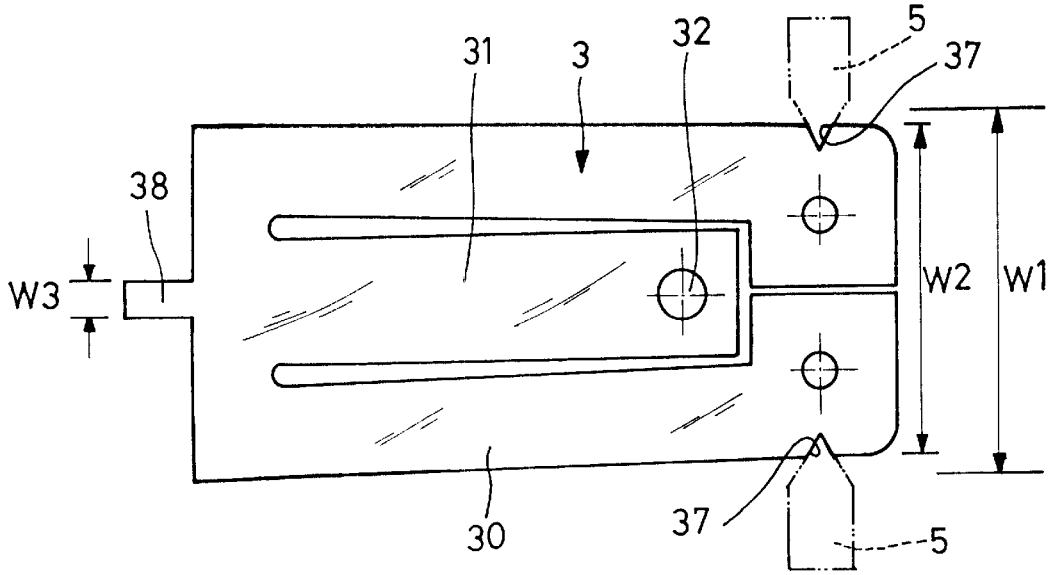
FIG. 12 is similar to FIG. 10 but showing the outer legs squeezed inwards toward each other.
Figure 13:
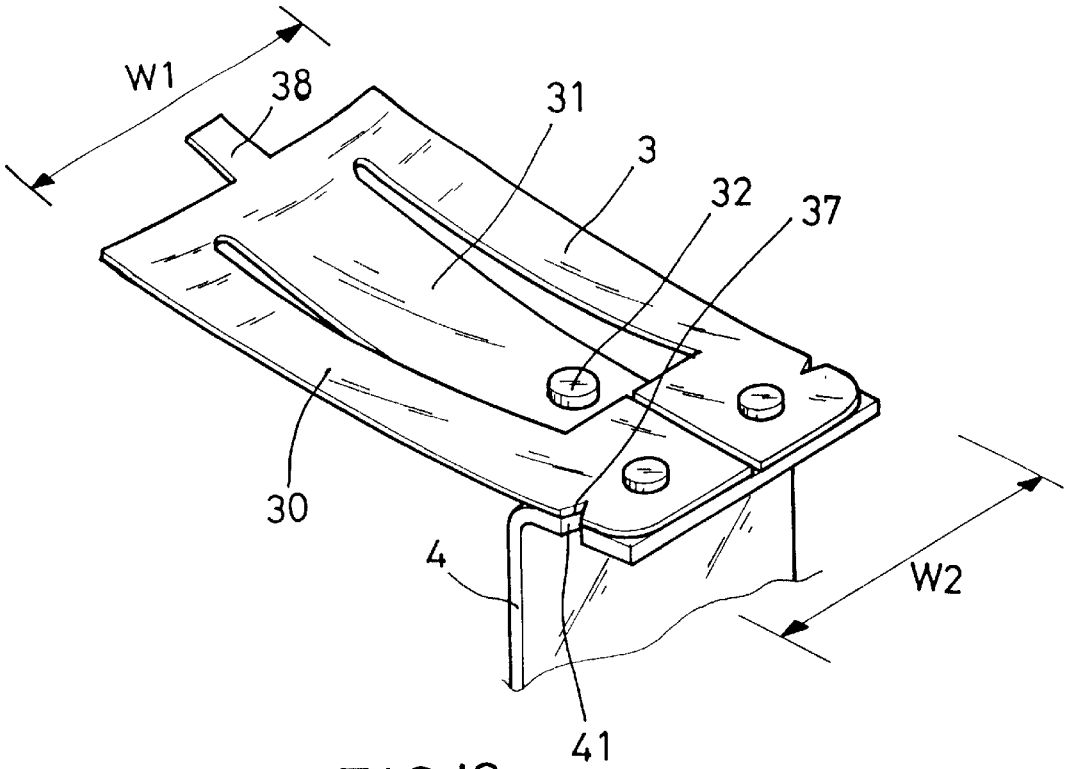
FIG. 13 shows the switching element installed in a support according to the present invention.
Figure 14:
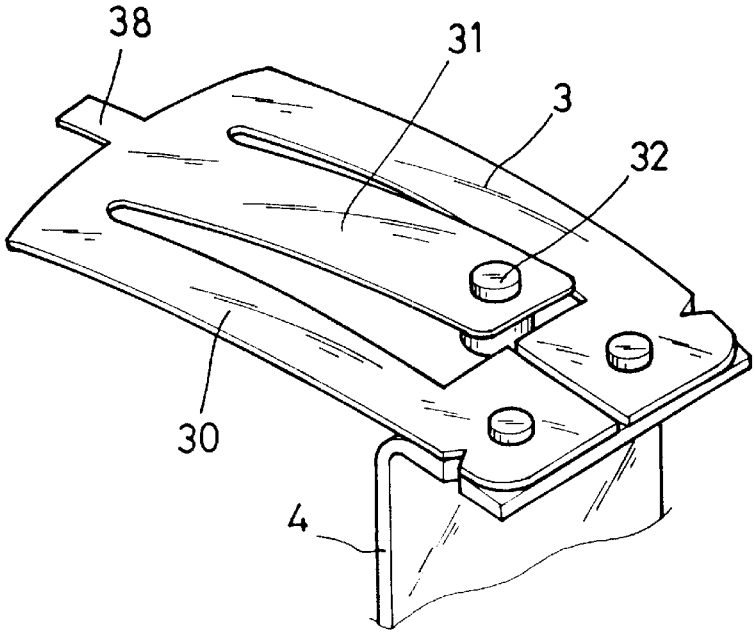
FIG. 14 is similar to FIG. 13 but showing the switching element reversed.
Figure 16:
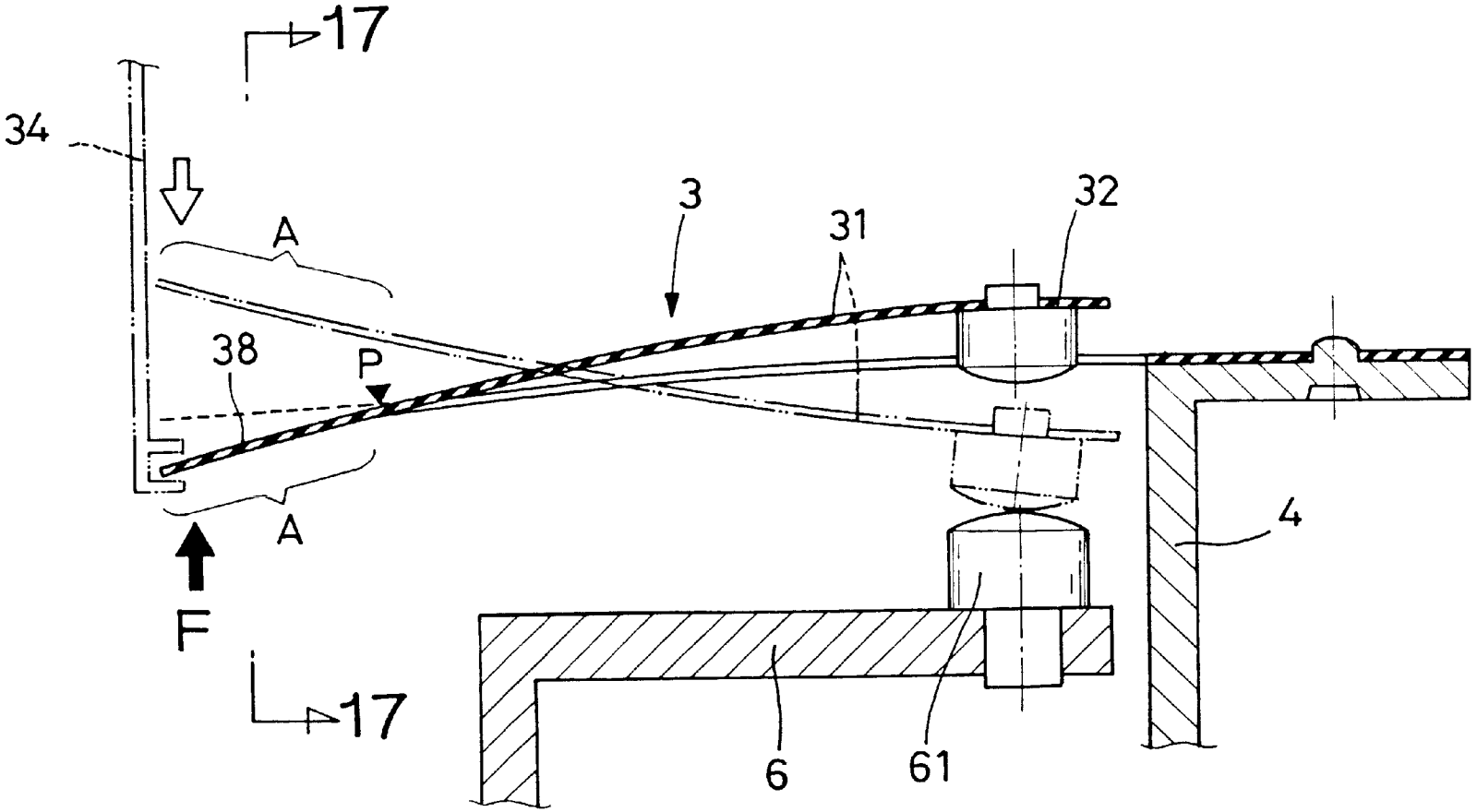
FIG. 16 is a schematic drawing showing the switching element switched between two positions according to the present invention.

Referring to FIGS. from 11 through 14 and FIG. 16, the switching element 3 is formed of a sheet of resilient metal having high and low heat-expansive sides. The switching element 3 has a middle leg 31 carrying one electric contact 32 for making and breaking a circuit with a stationary contact 61 on a substrate 6 below, and first and second outer legs 30 each having one end connected to the same end of the middle leg 31. During installation, the outer legs 30 are squeezed inwards toward each other to narrow the gap T1 between the other ends of the outer legs, so that the width of the mounting side is reduced from W1 to W2 (see FIGS. 11 and 12). After installation in a support 4, the switching element 3 is curved inwards/outwards, causing the middle leg 31 to move the contact 32 toward or away from the contact 61 as to switch on/off the circuit (see FIG. 16). Further, the outer legs 30 each have a notch 37 disposed at an outer side near the mounting side of the switching element 3 for the positioning of the tool elements 5 being operated to squeeze the outer legs 30 inwards toward each other. The support 4 has two notches 41 corresponding to the notch 37 of each of the outer legs 30 for quick installation.

The switching element 3 further comprises an arm 38 axially outwardly extended from the connection area between the middle leg 31 and the outer legs 30 in longitudinal alignment with the middle leg 31 and the gap T1. The width W3 of the arm 30 must be limited so as not to affect the bi-direction curving action of the switching element 3. Preferably, the width E3 of the arm 30 is about ⅕~1/10 of the width W1 of the proximity side (remote from the mounting side) of switching element 3. According to tests, the arm 38 cannot control the bi-direction curving action of the switching element 3 if the width W3 of the arm 30 surpasses ⅓ of the width W1 of the proximity side of the switching element 3.

Figure 1:
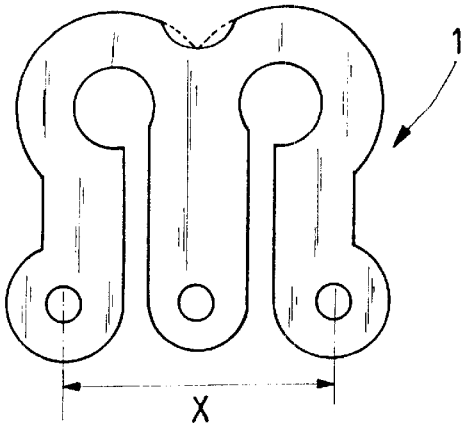
FIG.1 PRIOR ART
FIG. 1 is a top view of a switching element constructed according to U.S. Pat. No. 2,777,032.
Figure 2:
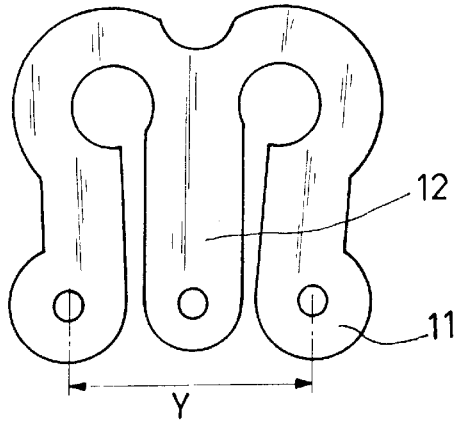
FIG.2 PRIOR ART
FIG. 2 is similar to FIG. 1 but showing the supporting legs squeezed inwards toward the center leg.
Figure 3:
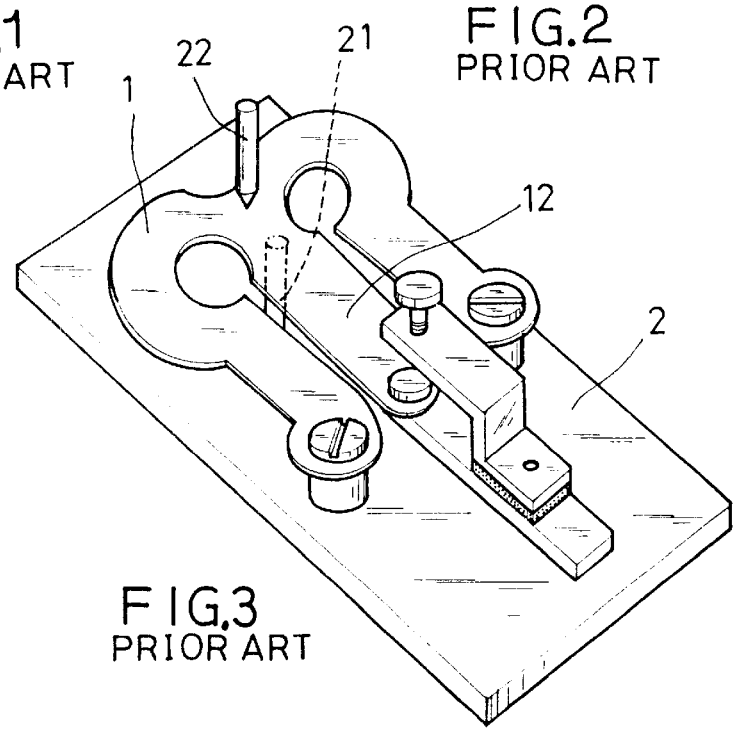
FIG.3 PRIOR ART
FIG. 3 shows the switching element of FIG. 1 installed in a substrate.
Figure 4:
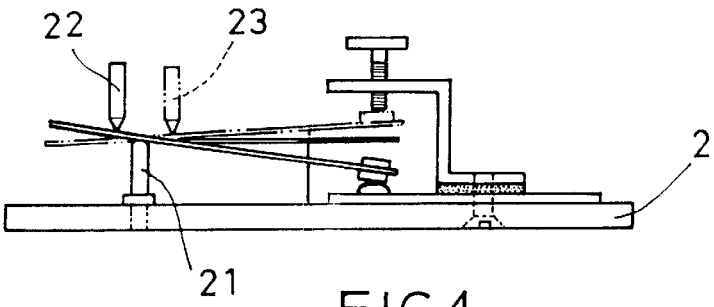
FIG.4 PRIOR ART
FIG. 4 is a schematic drawing showing the switching element of FIG. 3 switched between two positions.
Figure 5:
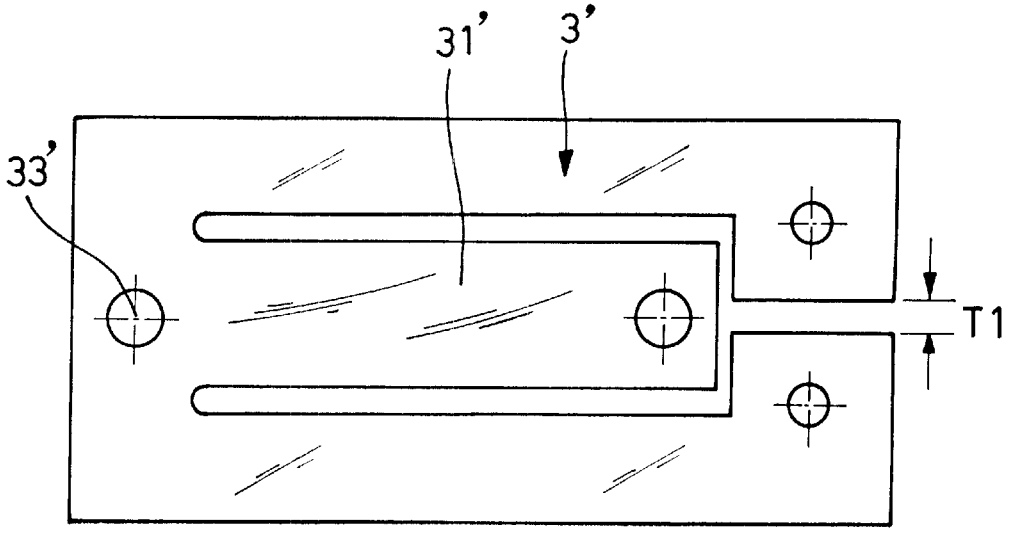
FIG. 5 PRIOR ART
FIG. 5 is a top view of a switching element constructed according to U.S. Pat. No. 5,760,672.
Figure 6:
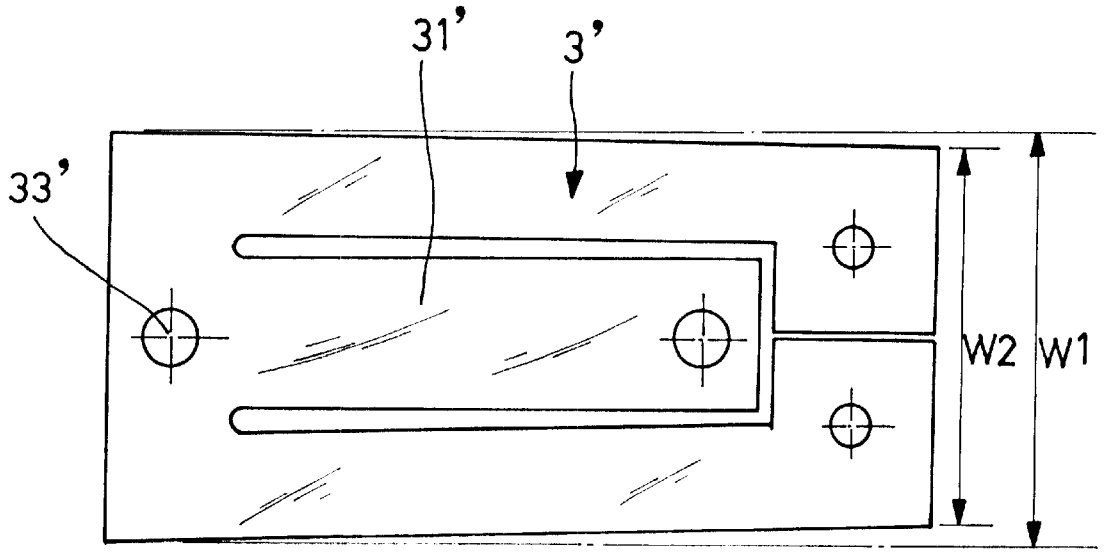
FIG. 6 PRIOR ART
FIG. 6 is similar to FIG. 5 but showing the outer legs squeezed inwards toward each other.
Figure 7:
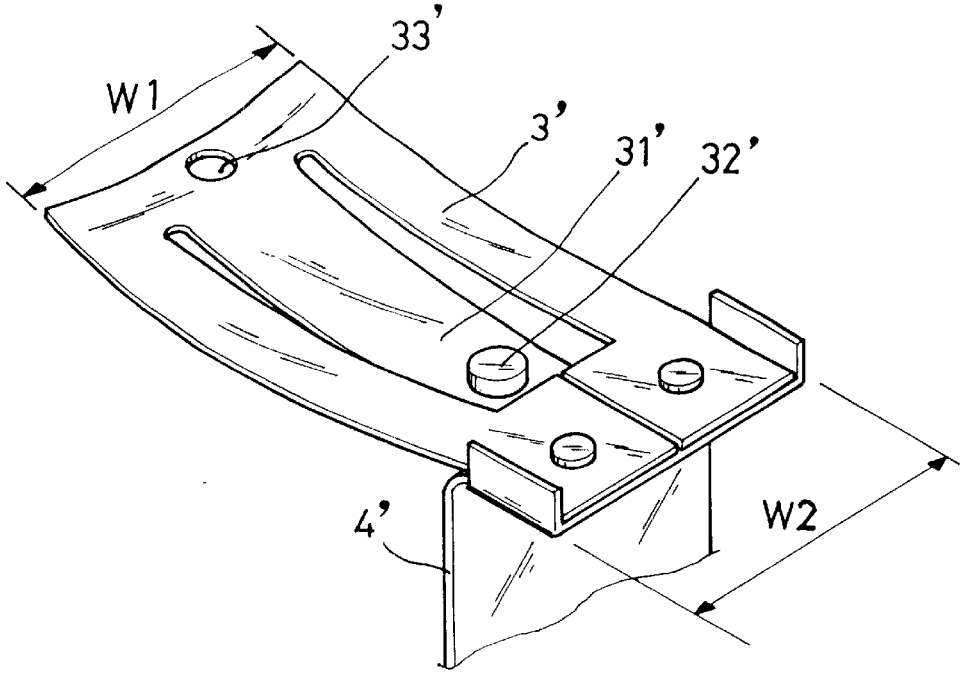
FIG.7 PRIOR ART
FIG. 7 shows the switching element of FIG. 5 installed in a support.
Figure 8:
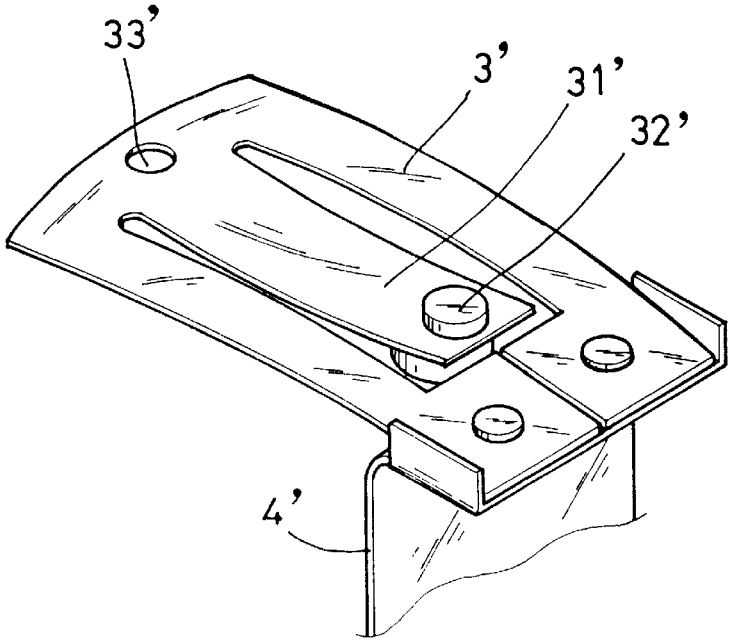
FIG.8 PRIOR ART
FIG. 8 is similar to FIG. 7 but showing the switching element reversed.
Figure 9:
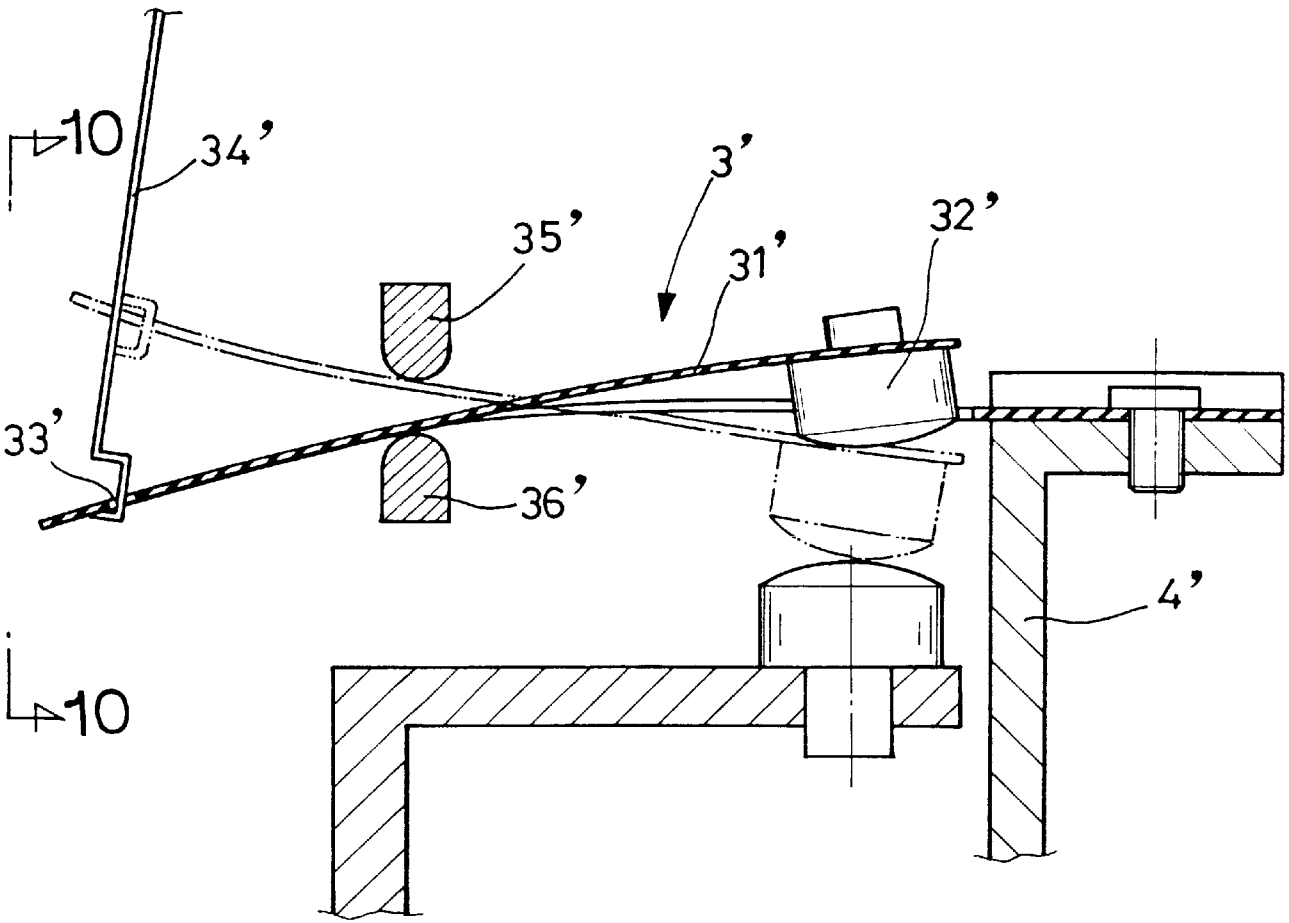
FIG.9 PRIOR ART
FIG. 9 is a schematic drawing showing the switching element switched between two positions according to U.S. Pat. No. 5,760,672.
Figure 10:
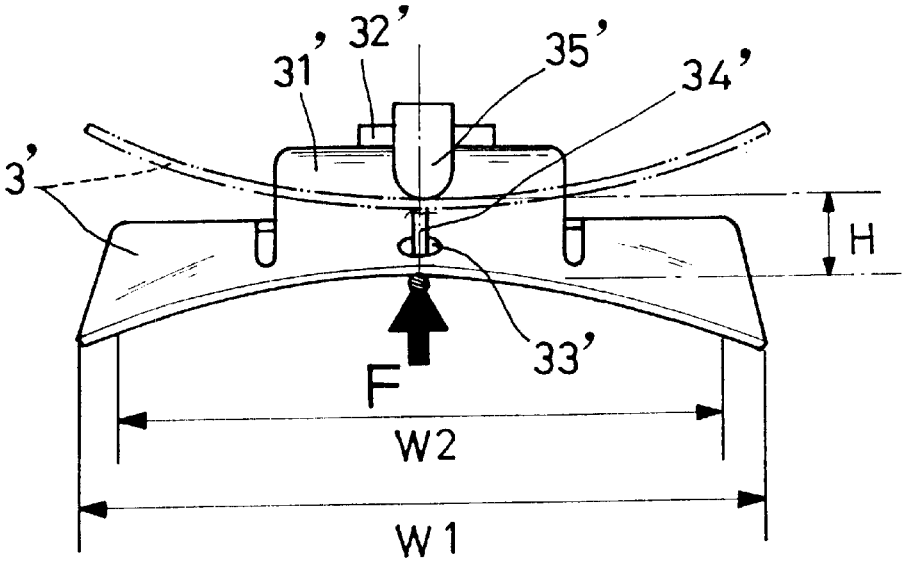
FIG.10 PRIOR ART
FIG. 10 is a sectional view taken along line 10—10 of FIG. 9.
Figure 17:
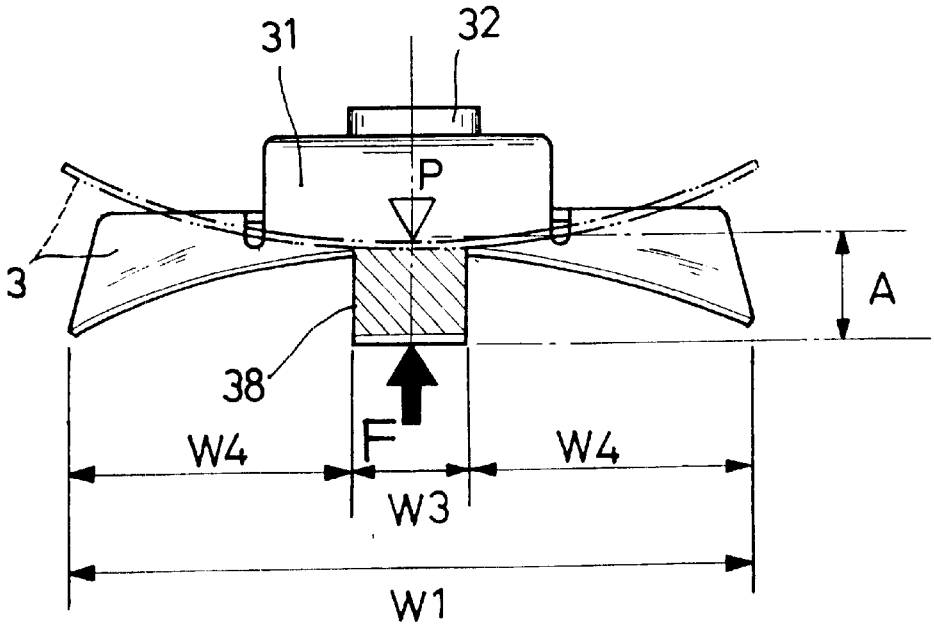
FIG. 17 is a sectional view taken along line 17—17 of FIG. 16.
Figure 15:
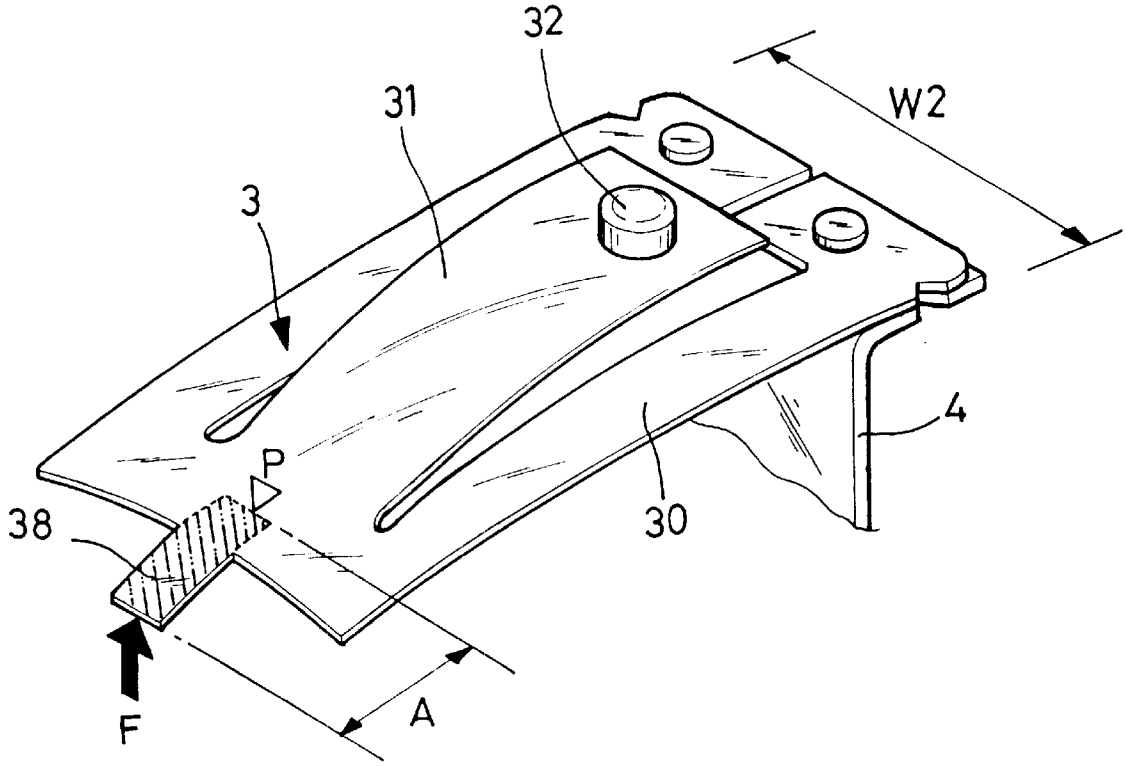
FIG. 15 illustrates the action of the brake arm of the switching element according to the present invention.

Referring to FIGS. From 15 through 17, the arm 38 is formed with the switching element 3 in one piece by stamping. The width W3 of the arm 38 is within ⅓ of the width W1 of the proximity side (the outer side) of the switching element 3. According to the embodiment shown in FIG. 15 or FIG. 17, the width W3 of the arm 38 is about ⅙ of the width W1 of the proximity side (the outer side) of the switching element 3. When imparting a force F to the arm 38, as shown in FIG. 15, the force is transmitted to the connecting area between the arm 38 and the switching element 3, producing a moment arm A. When pulling the arm 38 upwards or pushing it downwards, a reversing force P is produced at the inner end of the moment arm A, thereby causing the middle leg 31 to be curved in the reversed direction.

Referring to FIGS. From 15 through 17 again, a push and pull rod 34 is coupled to the end of the arm 38, and controlled to move the arm 38 up and down. When pulling the arm 38 upwards over the horizontal line of the switching element 3, the aforesaid reversing force P causes the middle leg 31 to curve inwards, thereby causing the contact 32 of the middle leg 31 to touch the contact 61 on the substrate 6, and therefore the circuit is "ON". On the contrary, when pushing the arm 38 downwards below the horizontal line of the switching element 3, the reversing force P causes the middle leg 31 to curve outwards, thereby causing the middle leg 31 to move its contact 32 away from the contact 61 on the substrate 6, and therefore the circuit is "OFF".

A prototype of switching element for electric switch has been constructed with the features of FIGS. 11~17. The switching element for electric switch functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A switching element of a sheet of resilient metal having high and low heat-expansive sides, the switching element having a mounting side and an actuating side, a middle leg carrying an electric contact for making and breaking a circuit with a stationary contact on a substrate below, and first and second outer legs each having one end connected to the same end of said middle leg at said actuating side, wherein the switching element further has an arm extended outwards from said actuating side in longitudinal alignment with said middle leg for pulling upwards/pushing downwards by an external force to reverse said middle leg, said arm having a width smaller than ⅓ of the width of said switching element.

2. The switching element of claim 1 wherein said outer legs each have a notch disposed at an outer side near the mounting side of said switching element.

* * * * *